US006210292B1

(12) United States Patent
Higuchi et al.

(10) Patent No.: US 6,210,292 B1
(45) Date of Patent: Apr. 3, 2001

(54) MULTI-PIECE SOLID GOLF BALL

(75) Inventors: Hiroshi Higuchi; Hisashi Yamagishi; Junji Hayashi; Shunichi Kashiwagi; Akira Kawata, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/389,323

(22) Filed: Sep. 3, 1999

(30) Foreign Application Priority Data

Sep. 3, 1998 (JP) ..... 10-249262

(51) Int. Cl.[7] ..... A63B 37/06
(52) U.S. Cl. ..... 473/374; 473/376
(58) Field of Search ..... 473/351, 367, 473/368, 370, 371, 373, 374, 376

(56) References Cited

U.S. PATENT DOCUMENTS 5,556,098 * 9/1996 Higuchi et al. ..... 473/373

FOREIGN PATENT DOCUMENTS 244174 9/1992 (JP) .
6-23069 2/1994 (JP) .
7-24084 1/1995 (JP) .
9-10358 1/1997 (JP) .
09010358 * 1/1997 (JP) ..... 273/62
9-313643 12/1999 (JP) .

* cited by examiner

*Primary Examiner*—Mark S. Graham
*Assistant Examiner*—Raeanne Gorden
(74) *Attorney, Agent, or Firm*—Sughrue, Mion, Zinn, Macpeak & Seas, PLLC

(57) ABSTRACT

A multi-piece solid golf ball including a relatively soft core, a very soft intermediate layer, and a thermoplastic resin-based cover harder than the intermediate layer by at least 20 Shore D units. The product (AxB) of the Shore D hardnesses of the cover and the intermediate layer and a dimple volume ratio $V_R$ (%) satisfy a specific relationship, and at least three types of dimples which are different in at least one of diameter, depth, and $V_0$ are formed on the ball surface. The ball has a very soft pleasant feel upon approach shots and putting, ease of control upon iron shots, and a satisfactory trajectory and improved flight performance upon full shots with a driver.

20 Claims, 2 Drawing Sheets

MULTI-PIECE SOLID GOLF BALL

This invention relates to a multi-piece solid golf ball comprising at least three layers, including a solid core, an intermediate layer, and a cover.

BACKGROUND OF THE INVENTION

Many two-piece solid golf balls are known in the art. As compared with wound golf balls, solid golf balls have the advantage of an increased total flight distance on both driver and iron shots, because of a straight liner trajectory and a low spin receptivity due to their structure, which allows for a long run. On the other hand, two-piece solid golf balls are more difficult to control than the wound golf balls in that they do not stop short on the green because of low spin receptivity on iron shots.

Like flight distance, a soft feel when hit is essential for golf balls. The absence of a soft feel represents a substantial loss of commodity value. As compared with the two-piece solid golf balls, the wound golf balls have the structural characteristics ensuring a soft and pleasant feel.

On two-piece solid golf balls consisting of a core and a cover, attempts have been made to soften the ball structure in order to accomplish a soft feel upon impact. A soft core is often used to obtain such soft-feel two-piece solid golf balls, but making the core softer lowers the resilience of the golf ball, compromises flight performance, and also markedly reduces durability. As a result, not only do these balls lack the excellent flight performance and durability characteristic of ordinary two-piece solid golf balls, but they are often in fact unfit for actual use.

Various three-piece solid golf balls having a three-layer construction in which an intermediate layer is situated between a solid core and a cover have been proposed to resolve these problems as disclosed, for example, in JP-A 7-24084, 6-23069, 4-244174, 9-10358, and 9-313643.

Golf balls having the cover and the intermediate layer made soft according to these proposals have a soft feel, but a shorter flight distance on full shots with a driver. To insure distance, the cover and the intermediate layer must be formed hard at the sacrifice of the feel upon approach shots and putting. Additionally, the spin performance on iron shots is also exacerbated so that the ball is less easy to control.

Numerous studies have been made on the dimples on the ball surface with respect to their shape (diameter and depth) and arrangement. It is difficult to optimize the dimples. Most golf balls suffer from the problem that they will sky high or drop upon full shots with a driver.

None of prior art solid golf balls fully meet the demands of players. A further improvement is thus desired.

SUMMARY OF THE INVENTION

Therefore, an object of the invention is to provide a multi-piece solid golf ball comprising at least three layers, a solid core, an intermediate layer, and a cover, which has a very soft pleasant feel upon approach shots and putting, ease of control upon iron shots, and a satisfactory trajectory and improved flight performance upon full shots with a driver.

The invention is directed to a multi-piece solid golf ball comprising a solid core, an intermediate layer of at least one layer around the core, and a cover of at least one layer around the intermediate layer, and having a plurality of dimples formed in the surface of the cover. The cover is formed of a cover stock composed mainly of a thermoplastic resin and has a Shore D hardness A, the intermediate layer has a Shore D hardness B, and the Shore D hardness A of the cover is at least 20 units higher than the Shore D hardness B of the intermediate layer. The product (AxB) of the Shore D hardness A of the cover multiplied by the Shore D hardness B of the intermediate layer and a dimple volume ratio $V_R$ (%) satisfy a specific requirement. The dimple volume ratio $V_R$ is the ratio of the sum Vs of volumes of dimple spaces each defined below a plane circumscribed by the dimple edge divided by the volume of an imaginary sphere given on the assumption that no dimples are on the golf ball surface, and is calculated according to the following equation:

$$V_R(\%) = \frac{Vs}{\frac{4}{3}\pi R^3} \times 100$$

wherein Vs is defined above and R is a ball radius. Namely, when the range of the product (AxB) is divided into sub-ranges, the value of $V_R$ should fall in a specific range for each of the sub-ranges of (AxB). Specifically, the product (AxB) and the dimple volume ratio $V_R$ (%) satisfy any one of the following relationships (1) to (6):

(1) $V_R$ is 0.79 to 1.15% when AxB is 150 to 500,
(2) $V_R$ is 0.78 to 1.14% when AxB is 500 to 1,000,
(3) $V_R$ is 0.77 to 1.13% when AxB is 1,000 to 1,500,
(4) $V_R$ is 0.76 to 1.12% when AxB is 1,500 to 2,000,
(5) $V_R$ is 0.75 to 1.11% when AxB is 2,000 to 2,500, and
(6) $V_R$ is 0.74 to 1.10% when AxB is at least 2,500.

The dimples include at least three types of dimples which are different in at least one of diameter, depth, and $V_0$, which is the volume of a dimple space below a plane circumscribed by the dimple edge divided by the volume of a cylinder whose bottom is the plane and whose height is the maximum depth of the dimple from the bottom. Upon driver shots, the ball receives an optimum spin rate and thus travels a satisfactory trajectory.

In one preferred embodiment, the solid core is formed mainly of a rubber base and has a specific gravity of 1.0 to 1.5. The solid core is made relatively soft as demonstrated by a deflection of at least 2.5 mm under an applied load of 100 kg.

In a further preferred embodiment, the intermediate layer is formed mainly of a very soft thermoplastic resin as demonstrated by a Shore D hardness of 5 to 35. More preferably, the intermediate layer is formed mainly of a heated mixture of (E1) a thermoplastic polyester elastomer and (E2) at least one thermoplastic elastomer selected from olefin elastomers, modified olefin elastomers, styrene block copolymers and hydrogenated styrene block copolymers, or the thermoplastic elastomer defined as (E2).

In a still further preferred embodiment, the intermediate layer has a thickness of 0.2 to 5.0 mm and a specific gravity of at least 0.8: and the cover is formed mainly of an ionomer resin, especially having a Shore D hardness of 40 to 70, and has a thickness of 1.0 to 5.0 mm and a specific gravity of at least 0.9.

When all these features are fulfilled, the ball is given a very soft pleasant feel upon approach shots and putting, a high spin receptivity and hence, ease of control upon iron shots, and a satisfactory trajectory and improved flight performance upon full shots with a driver.

DESCRIPTION OF THE PREFERRED EMBODIMENTS

Figure 1:
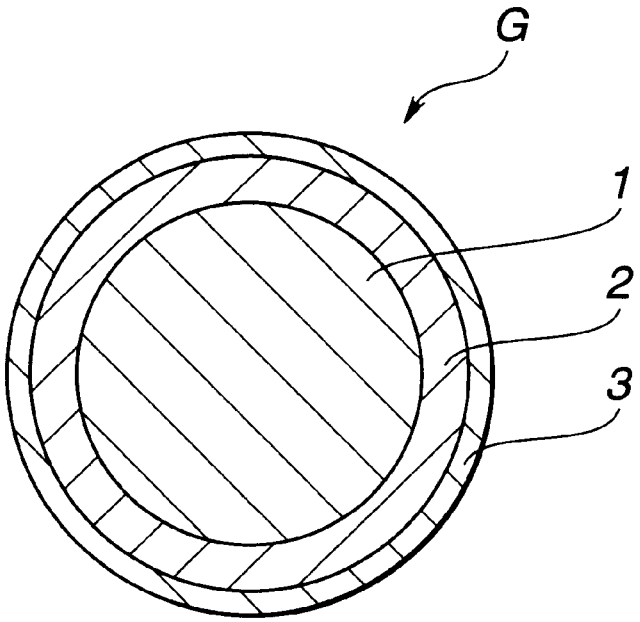
FIG. 1 is a cross-sectional view of a multi-piece solid golf ball according to one embodiment of the invention.

Referring to FIG. 1, a multi-piece solid golf ball G according to the invention is schematically illustrated as comprising a solid core 1, an intermediate layer 2 of at least one layer surrounding the core 1, and a cover 3 of at least one layer surrounding the intermediate layer 2. The cover is provided on its surface with at least three types of dimples which are different in at least one of diameter, depth, and $V_0$. The product (AxB) of the Shore D hardnesses of the cover and the intermediate layer and the dimple volume ratio $V_R$ satisfy the specific requirement.

The solid core may be formed of a rubber composition primarily comprising a base rubber which is based on polybutadiene rubber, polyisoprene rubber, natural rubber or silicone rubber. Polybutadiene rubber is preferred especially for improved resilience. The preferred polybutadiene rubber is cis-1,4-polybutadiene containing at least 40% cis structure. In the base rubber, another rubber component such as natural rubber, polyisoprene rubber or styrene-butadiene rubber may be blended with the polybutadiene if desired. For high resilience, the other rubber component should preferably be less than about 10 parts by weight per 100 parts by weight of polybutadiene.

In the rubber composition, a crosslinking agent may be blended with the rubber component. Exemplary crosslinking agents are zinc and magnesium salts of unsaturated fatty acids such as zinc methacrylate and zinc diacrylate, and esters such as trimethylpropane methacrylate. Of these, zinc diacrylate is preferred because it can impart high resilience. The crosslinking agent is preferably used in an amount of about 15 to 40 parts by weight per 100 parts by weight of the base rubber. A vulcanizing agent such as dicumyl peroxide or a mixture of dicumyl peroxide and 1,1-bis(t-butylperoxy)-3,3,5-trimethylcyclohexane may also be blended in the rubber composition, preferably in an amount of about 0.1 to 5 parts by weight per 100 parts by weight of the base rubber. In the rubber composition, an antioxidant and a specific gravity adjusting filler such as zinc oxide or barium sulfate may be blended. The amount of filler blended is 0 to about 130 parts by weight per 100 parts by weight of the base rubber.

The core-forming rubber composition is obtained by kneading the above-mentioned components in a conventional mixer such as a kneader, Banbury mixer or roll mill. The resulting compound is molded in a mold by injection or compression molding.

Preferably the solid core has a diameter of 25 to 40 mm, more preferably 27 to 39 mm, and most preferably 30 to 38 mm; a weight of 10 to 40 g, more preferably 15 to 35 g, and most preferably 20 to 32 g; and a specific gravity of 1.0 to 1.5, more preferably 1.10 to 1.45, and most preferably 1.15 to 1.40.

The solid core should preferably have a deflection of at least 2.5 mm, more preferably 2.8 to 6.0 mm, further preferably 3.0 to 5.5 mm, and most preferably 3.3 to 5.0 mm, under an applied load of 100 kg. With a core deflection of less than 2.5 mm, the feel of the ball would become hard. With a core deflection of more than 6.0 mm, the resilience becomes too low.

The core is usually formed to a single layer structure from one material although it may also be formed to a multilayer structure of two or more layers of different materials.

According to the invention, the intermediate layer 2 of at least one layer, preferably one or two layers, is formed around the core 1.

Preferably the intermediate layer is formed mainly of a very soft thermoplastic resin having a Shore D hardness of 5 to 35. As the thermoplastic resin of which the intermediate layer is formed, use is made of heated mixtures of (E1) a thermoplastic polyester elastomer and (E2) at least one thermoplastic elastomer selected from olefin elastomers, modified olefin elastomers, styrene block copolymers and hydrogenated styrene block copolymers. It is also preferred to use the thermoplastic elastomers (E2) alone.

Of the thermoplastic polyester elastomers (E1), polyether ester type multi-block copolymers are preferred which are synthesized from terephthalic acid, 1,4-butane diol, and polytetramethylene glycol (PTMG) or polypropylene glycol (PPG) so that polybutylene terephthalate (PBT) moieties and polytetramethylene glycol (PTGM) or polypropylene glycol (PPG) moieties may serve as hard and soft segments, respectively. For example, commercially available elastomers such as Hytrel 3078, Hytrel 4047 and Hytrel 4767 from Toray-Dupont K.K. may be used.

With respect to (E2), the olefin elastomers include copolymers of ethylene with alkenes of at least 3 carbon atoms, preferably copolymers of ethylene with alkenes of 3 to 10 carbon atoms, and copolymers of α-olefins with unsaturated carboxylic acid esters or carboxyl or carboxylic anhydride group-bearing polymerizable monomers. Exemplary olefin elastomers are ethylene-propylene copolymer rubber, ethylene-butene copolymer rubber, ethylene-hexene copolymer rubber, and ethylene-octene copolymer rubber. Also included are copolymers obtained by adding to the above components a third component, for example, by adding to ethylene-propylene copolymers a non-conjugated diene such as 5-ethylidene norbornene, 5-methylnorbornene, 5-vinylnorbornene, dicyclopentadiene or butene. Illustrative examples are ethylene-propylene-butene copolymers, ethylene-propylene-butene copolymer rubber, and ethylene-ethyl acrylate copolymer resins. These olefin elastomers are commercially available under the trade name of MITUIEPT and Toughmer from Mitsui Chemical Industry K.K., ENGAGE from Dow Chemical, and Dynaron from Nippon Synthetic Rubber K.K.

Modified products of the above-mentioned olefin elastomers are also useful. Such modified olefin elastomers include ethylene-ethyl acrylate copolymer resins graft modified with maleic anhydride. They are commercially available under the trade name of HPR from Mitsui-Dupont Polychemical K.K.

Component (E2) also includes styrene block copolymers, preferably those copolymers having conjugated diene blocks composed of butadiene alone, isoprene alone or a mixture of isoprene and butadiene. Also useful are hydrogenated products of these styrene block copolymers, for example, hydrogenated styrene-butadiene-styrene block copolymers and hydrogenated styrene-isoprene-styrene block copolymers. Such hydrogenated styrene-conjugated diene block copolymers are commercially available under the trade name of Dynaron from Nippon Synthetic Rubber K.K., Septon and Hiblur from Kurare K.K., and Toughtec from Asahi Chemicals Industry K.K.

In the preferred embodiment wherein the intermediate layer is formed of a composition primarily comprising a heated mixture of (E1) a thermoplastic polyester elastomer and (E2) at least one thermoplastic elastomer selected from olefin elastomers, modified olefin elastomers, styrene block copolymers and hydrogenated styrene block copolymers, these components are preferably mixed so that the mixture may contain up to 95% by weight of component (E1). That is, the mixture preferably has an (E1)/(E2) ratio of from 95/5 to 0/100, more preferably from 90/10 to 5/95, most preferably from 80/20 to 10/90, expressed in % by weight. The mixture of (E1) and (E2) is commercially available under the trade name of Primalloy from Mitsubishi Chemical K.K.

The intermediate layer may also be formed of a composition primarily comprising the thermoplastic elastomer (E2) selected from olefin elastomers, modified olefin elastomers, styrene block copolymers and hydrogenated styrene block copolymers, alone or mixtures thereof.

In addition to the above-mentioned resin components, the composition of which the intermediate layer is formed may further contain a weight adjusting agent, coloring agent, dispersant, and other additives, if necessary.

Any desired method may be used in forming the intermediate layer around the core. Conventional injection or compression molding may be employed.

The thus molded intermediate layer preferably has a Shore D hardness B of 5 to 35, more preferably 6 to 33, further preferably 7 to 30, still further preferably 8 to 27, still further preferably 9 to 24, and most preferably 10 to 23. A layer with a Shore D hardness of less than 5 would be too soft, less resilient, less durable and unfit for actual use. An intermediate layer with a Shore D hardness of more than 35 would be too hard, leading to a hard feel on approach shots and putting and failing to achieve the objects of the invention.

The intermediate layer preferably has a thickness of 0.2 to 5.0 mm, more preferably 0.5 to 4.0 mm, most preferably 0.7 to 3.5 mm, and a specific gravity of at least 0.8, more preferably 0.85 to 1.4, further preferably 0.87 to 1.2, most preferably 0.89 to 1.15.

The cover 3 of at least one layer, preferably one or two layers, is formed around the intermediate layer 2. The cover is formed mainly of a thermoplastic resin which is at least 20 Shore D hardness units harder than the intermediate layer.

The cover may be formed mainly of a conventional thermoplastic resin, examples of which include ionomer resins, polyester elastomers, polyamide elastomers, styrene elastomers, polyurethane elastomers, olefin elastomers and mixtures thereof. Of these, the ionomer resins are preferred. Use may be made of commercially available ionomer resins such as "Himilan" from Mitsui-Dupont Polychemical K.K. and "Surlyn" from Dupont. To the cover composition, there may be added UV absorbers, antioxidants and dispersants such as metal soaps, if necessary.

Any desired method may be used in forming the cover around the intermediate layer. Conventional injection or compression molding may be employed.

The thus molded cover preferably has a Shore D hardness A of 40 to 70, more preferably 45 to 65, further preferably 50 to 64, and most preferably 52 to 58. The Shore D hardness A of the cover should be higher than the Shore D hardness B of the intermediate layer by at least 20 units, preferably 20 to 60 units, more preferably 25 to 55 units, and most preferably 30 to 50 units. If the difference in hardness between the cover and the intermediate layer, that is, (A–B) is less than 20 Shore D units, the cover would be relatively soft, leading to a reduced resilience. A too much hardness difference of more than 60 Shore D units would lead to reduced durability, an increased energy loss and a reduced flight distance.

The product (AxB) of the Shore D hardness A of the cover multiplied by the Shore D hardness B of the intermediate layer falls in the range of 150 to 2,500 or more, preferably in the range of 150 to 4,000, more preferably 300 to 2,500, further preferably 500 to 2,000, and most preferably 800 to 1,500.

The cover preferably has a thickness of 1.0 to 5.0 mm, more preferably 1.2 to 4.0 mm, further preferably 1.3 to 3.0 mm, most preferably 1.4 to 2.5 mm, and a specific gravity of at least 0.9, more preferably 0.92 to 1.4, further preferably 0.93 to 1.3, most preferably 0.96 to 1.2.

An appropriate amount of an inorganic filler may be added to the cover composition because the loading of the cover with the inorganic filler can effectively compensate for a loss of durability resulting from the intermediate layer made very soft. Preferably about 5 to 40 parts, more preferably about 15 to 38 parts, most preferably about 18 to 36 parts by weight of the inorganic filler is added to 100 parts by weight of the resin component of which the cover is formed. Less than 5 parts of the filler would provide little reinforcement whereas more than 40 parts of the filler would adversely affect dispersion and resilience.

The inorganic filler blended herein generally has a mean particle size of 0.01 to 100 $\mu$m, preferably 0.1 to 10 $\mu$m, and more preferably 0.1 to 1.0 $\mu$m. Outside the range, larger or smaller filler particles would be difficult to disperse, failing to achieve the objects of the invention. Examples of the inorganic filler include barium sulfate, titanium dioxide, calcium carbonate, and tungsten, though not limited thereto. They may be used alone or in admixture of two or more. Barium sulfate and titanium dioxide are most preferable.

An appropriate amount of an inorganic filler may also be added to the intermediate layer. By adding the inorganic fillers to both the cover and the intermediate layer, a further improvement in durability is made. Preferably about 5 to 40 parts, more preferably about 15 to 38 parts by weight of the inorganic filler is added to 100 parts by weight of the resin component of which the intermediate layer is formed. The type, mean particle size and other parameters of the inorganic filler are the same as described for the cover.

The multi-piece solid golf ball of the invention has a plurality of dimples formed in its cover surface. The dimples are formed such that when the product (AxB) of the Shore D hardness A of the intermediate layer multiplied by the Shore D hardness B of the cover is in the range from 150 to 2,500 or more, which is divided into sub-ranges, a factor $V_R$ associated with the dimples, that is, a dimple volume ratio $V_R$ (%) of the sum of the volumes of dimple spaces each defined below a plane circumscribed by the dimple edge to the volume of a phantom sphere given on the assumption that the golf ball surface is free of dimples satisfies any one of the following relationships (1) to (6).

(1) $V_R$ is 0.79 to 1.15%, preferably 0.795 to 1.145% when AxB is 150 to 500, (2) $V_R$ is 0.78 to 1.14%, preferably 0.785 to 1.135% when AxB is 500 to 1,000, (3) $V_R$ is 0.77 to 1.13%, preferably 0.775 to 1.125% when AxB is 1,000 to 1,500, (4) $V_R$ is 0.76 to 1.12%, preferably 0.765 to 1.115% when AxB is 1,500 to 2,000, (5) $V_R$ is 0.75 to 1.11%, preferably 0.755 to 1.105% when AxB is 2,000 to 2,500, and (6) $V_R$ is 0.74 to 1.10%, preferably 0.745 to 1.095% when AxB is at least 2,500.

When the value of $V_R$ is outside the above-specified range relative to the Shore D hardness product (AxB), a prematurely falling trajectory and a reduced flight distance there.

The value $V_R$ is the ratio (%) of the sum of volumes Vp of dimple spaces defined in the golf ball surface to be described later to the volume of a phantom sphere given on the assumption that the golf ball surface is free of dimples and is calculated according to the following equation:

$$V_R(\%) = \frac{Vs}{\frac{4}{3}\pi R^3} \times 100$$

wherein Vs is the sum of the volumes Vp of dimple spaces each below a circular plane circumscribed by the dimple edge and R is a ball radius.

It is noted that Vs in the above equation is represented by the following equation and $V_R$ can be calculated by substituting the value of Vs into the above equation of $V_R$.

$$Vs = N_1 Vp_1 + N_2 Vp_2 + \ldots + N_n Vp_n = \sum_{i=1}^{n} NiVpi$$

$Vp_1$, $Vp_2$, . . . $VP_n$ represent the volumes of dimples of different dimensions and $N_1$, $N_2$, . . . $N_n$ represent the number of dimples having the volumes $Vp_1$, $Vp_2$, . . . $Vp_n$, respectively.

In addition to the above-mentioned requirement of $V_R$ value, the dimples formed in the golf ball of the invention must further satisfy the requirement that there are included at least three types, preferably three to six types of dimples which are different in at least one of a diameter, a depth, and a value $V_0$ which is the volume of one dimple space defined below a plane circumscribed by the dimple edge divided by the volume of a cylinder whose bottom is the plane and whose height is the maximum depth of the dimple from the bottom. If the number of dimple types is less than 3, there arises the problem that the golf ball lofts or skies too high or drops prematurely.

Figure 2:
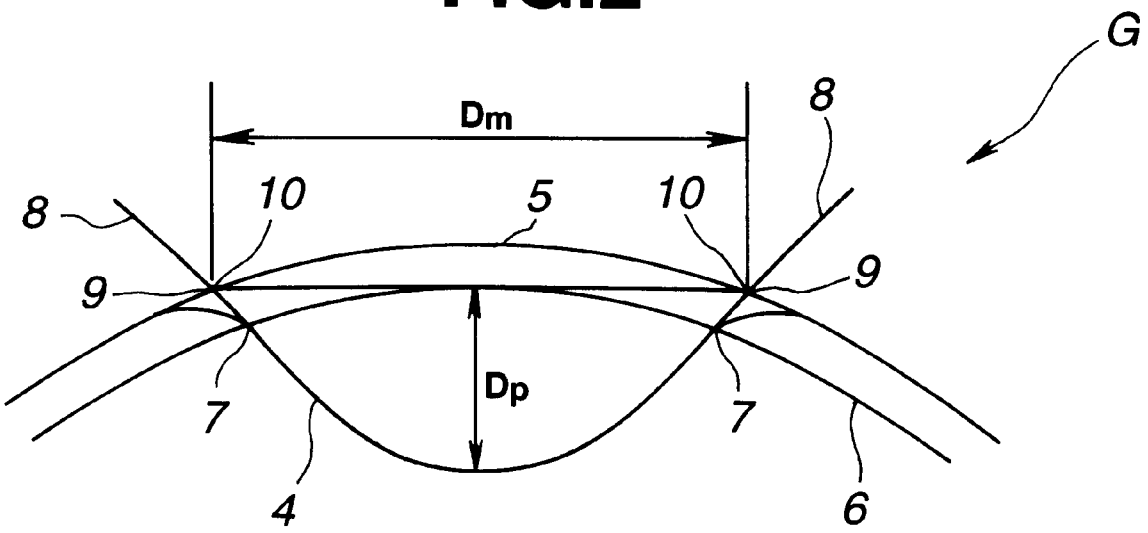
FIG. 2 is a schematic cross-sectional view of a dimple illustrating how to calculate $V_0$.
Figure 3:
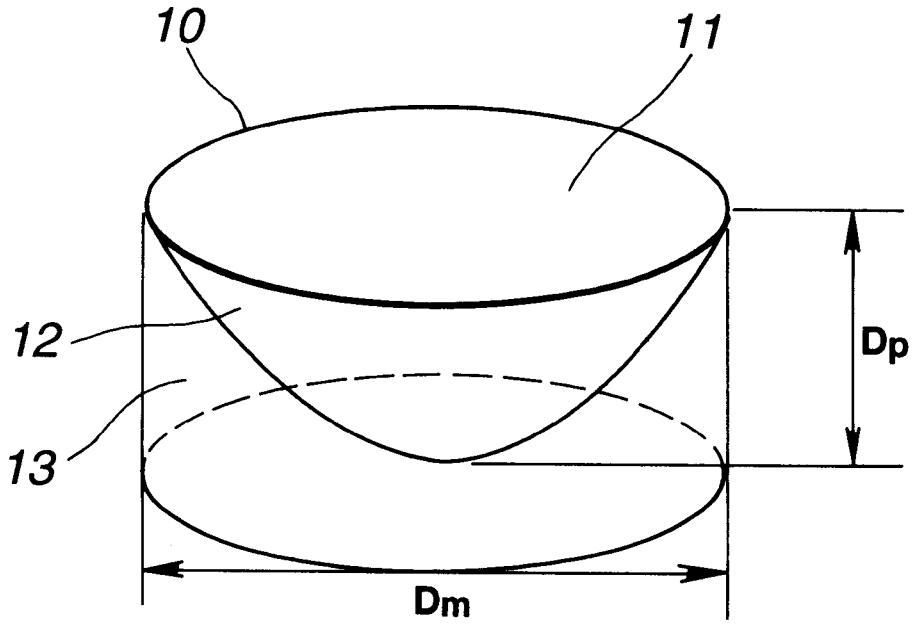
FIG. 3 is a perspective view of the same dimple.
Figure 4:
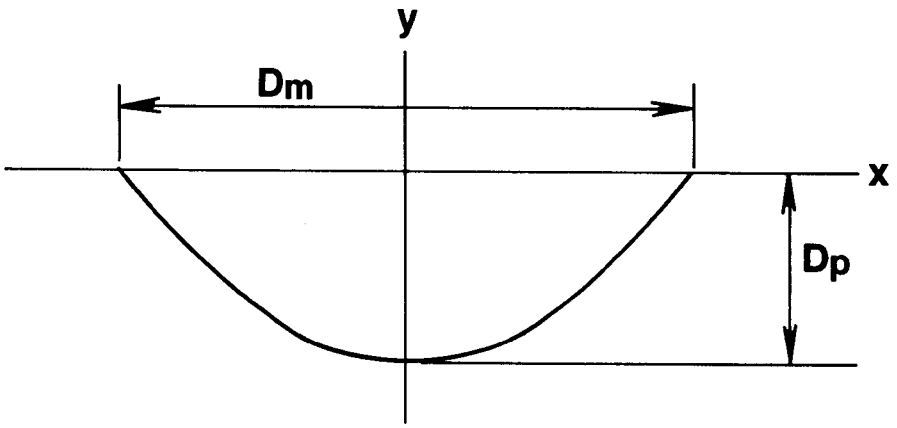
FIG. 4 is a cross-sectional view of the same dimple.

The value $V_0$ associated with the dimple requirement is described below. In the event that the planar shape of a dimple is circular, as shown in FIG. 2, a phantom sphere 5 having the ball diameter and another phantom sphere 6 having a diameter smaller by 0.16 mm than the ball diameter are drawn in conjunction with a dimple 4. The circumference of the other sphere 6 intersects with the dimple 4 at a point 7. A tangent 8 at intersection 7 intersects with the phantom sphere 5 at a point 9 while a series of intersections 9 define a dimple edge 10. The dimple edge 10 is so defined for the reason that otherwise, the exact position of the dimple edge cannot be determined because the actual edge of the dimple 4 is rounded. The dimple edge 10 circumscribes a plane 11 (circle having a diameter Dm). Then, the dimple space 12 located below the plane 11 as shown in FIGS. 3 and 4 has a volume Vp. A cylinder 13 whose bottom is the plane 11 and whose height is the maximum depth Dp of the dimple from the plane 11 has a volume Vq. The ratio $V_0$ of the dimple space volume Vp to the cylinder volume Vq is calculated.

$$Vp = \int_0^{\frac{Dm}{2}} 2\pi xy\,dx$$

$$Vq = \frac{\pi Dm^2 Dp}{4}$$

$$V_0 = \frac{Vp}{Vq}$$

In the event that the planar shape of a dimple is not circular, the maximum diameter or length of a dimple is determined, the plane projected shape of the dimple is assumed to be a circle having a diameter equal to this maximum diameter or length, and $V_0$ is calculated as above based on this assumption.

With respect to the dimples of different types according to the invention, dimples of the largest type preferably have a diameter of 3.7 to 4.5 mm, especially 3.8 to 4.3 mm and a depth of 0.15 to 0.25 mm, especially 0.155 to 0.23 mm, and their number is preferably 5 to 80%, especially 10 to 75% of the total dimple number. They are preferably set to have a $V_0$ value of 0.38 to 0.55, more preferably 0.4 to 0.52.

Among the dimples of different types, dimples of the smallest type preferably have a diameter of 2.0 to 3.7 mm, especially 2.4 to 3.6 mm and a depth of 0.08 to 0.23 mm, especially 0.09 to 0.21 mm, and their number is preferably 1 to 40%, especially 2 to 30% of the total dimple number. They are preferably set to have a $V_0$ value of 0.38 to 0.55, especially 0.4 to 0.52.

The golf ball as a whole should preferably have a $V_0$ value of 0.38 to 0.55, more preferably 0.4 to 0.52, especially 0.42 to 0.5. A $V_0$ value of less than 0.38 is likely not to have a lasting trajectory whereas a $V_0$ value of more than 0.55 is likely to lead to a high rise or aloft trajectory.

In the practice of the invention, the total number of dimples is not critical although usually 360 to 460 dimples, especially 370 to 450 dimples are formed. The arrangement of dimples on the ball surface is not critical and any of well-known regular octahedral and regular icosahedral arrangements may be used.

There has been described a multi-piece solid golf ball comprising a relatively soft core, a very soft intermediate layer enclosing the core, and a cover harder than the intermediate layer by at least 20 Shore D units, wherein the product (AxB) of the Shore D hardnesses of the cover and the intermediate layer and a dimple volume ratio $V_R$ (%) satisfy the specific relationship, and at least three types of dimples which are different in at least one of diameter, depth, and $V_0$ are formed on the ball surface. Owing to these features combined, the ball has a very soft pleasant feel upon approach shots and putting, a high spin receptivity and ease of control upon iron shots, and a satisfactory trajectory and improved flight performance upon full shots with a driver.

The ball as a whole preferably has a deflection of 2.3 to 6.0 mm, more preferably 2.6 to 5.5 mm, more preferably 2.8 to 4.6 mm, under an applied load of 100 kg. The golf ball must have a diameter of not less than 42.67 mm and a weight of not greater than 45.93 grams in accordance with the Rules of Golf. Preferably the ball has a weight of 44.5 to 45.8 grams, more preferably 44.9 to 45.7 grams, and most preferably 45.2 to 45.6 grams.

EXAMPLE

Examples of the invention are given below by way of illustration and not by way of limitation. The amounts of ingredients in Tables 1 to 3 are parts by weight.

Examples 1–5 & Comparative Examples 1–7

Core-forming rubber compositions of the formulation shown in Table 1 were mixed in a kneader and molded and vulcanized in a core mold at a temperature of 155° C. for about 15 minutes, forming solid cores.

Around the cores, the intermediate layer and cover were formed by injection molding the intermediate layer compositions of the formulation shown in Table 2 and the cover compositions of the formulation shown in Table 3, respectively. There were obtained three-piece solid golf balls in Examples 1–5 and Comparative Examples 1, 2, 4 and 5.

The three-piece ball of Comparative Example 3 was prepared by preforming a pair of half shells from the intermediate layer composition of the formulation shown in Table 2, encasing the core within the half shells, vulcanizing the assembly in a mold at 155° C. for 15 minutes to form a dual solid core, and injection molding the cover composition around the dual solid core.

The three-piece ball of Comparative Example 7 was prepared by preforming a pair of half shells from the intermediate layer composition of the formulation shown in Table 2, encasing the core within the half shells, vulcanizing the assembly in a mold at 170° C. for 15 minutes to form a dual solid core, and injection molding the cover composition around the dual solid core. Comparative Example 6 was a two-piece golf ball consisting of the core and the cover without the intermediate layer.

On the surface of these golf balls, dimples having the parameters shown in Table 4 were distributed in the combination shown in Tables 5 and 6.

The golf balls were examined for several properties by the following tests. The results are shown in Tables 5 and 6.

Solid core deflection

The deflection (mm) of the solid core under an applied load of 100 kg was measured.

Flight performance

A swing robot (by Miyamae K.K.) was equipped with a driver (W#1, PRO 230 Titan, loft angle 10°, by Bridgestone Sports Co., Ltd.). The ball was struck with the driver at a head speed of 45 m/sec (HS 45), and the carry, total distance, and spin rate were measured. The club was changed to No. 9 iron (I#9, Model 55-HM, loft angle 44°, by Bridgestone Sports Co., Ltd.). The ball was struck with the iron at a head speed of 33 m/sec (HS 33), and the spin rate was measured.

Trajectory

Twelve golf balls of each example were hit under the same conditions as in the flight performance test to visually observe a trajectory.

Feel

Five professional golfers actually hit the ball with the driver (W#1), No. 9 iron (I#9), and putter (PT) and evaluated according to the following criterion.

VS: very soft

Av: ordinary

Hard: hard

Durability

Using a swing robot (by Miyamae K.K.), the ball was repeatedly struck with a driver (PRO 230 Titan, loft angle 10°, Bridgestone Sports Co., Ltd.) at a head speed of 45 m/sec. The surface state of the ball was evaluated relative to the number of strikes and rated according to the following criterion.

OK: no problem

W:. relatively premature breakage

VW: premature breakage

TABLE 1

| | Example | | | | | Comparative Example | | | | | | |
|---|---|---|---|---|---|---|---|---|---|---|---|---|
| | 1 | 2 | 3 | 4 | 5 | 1 | 2 | 3 | 4 | 5 | 6 | 7 |
| Polybutadiene* | 100 | 100 | 100 | 100 | 100 | 100 | 100 | 100 | 100 | 100 | 100 | 100 |
| Zinc diacrylate | 21 | 20 | 26 | 35 | 24 | 33 | 33 | 38 | 34 | 34 | 23.5 | 38 |
| Dicumyl peroxide | 1 | 1 | 1 | 1 | 1 | 1 | 1 | 1 | 1 | 1 | 1 | 1 |
| Antioxidant | 0.1 | 0.1 | 0.1 | 0.1 | 0.1 | 0.1 | 0.1 | 0.1 | 0.1 | 0.1 | 0.1 | 0.1 |
| Barium sulfate | 12.8 | 29.2 | 19.1 | 50.9 | 4.9 | 17 | 19 | 20.4 | 12.6 | 20.3 | 18 | 20.4 |
| Zinc oxide | 5 | 5 | 5 | 5 | 5 | 5 | 5 | 5 | 5 | 5 | 5 | 5 |
| Zinc salt of pentachlorothiophenol | 1 | 1 | 1 | 1 | 1 | 1 | 1 | 1 | 1 | 1 | 1 | 1 |

*BR01 by Nippon Synthetic Rubber K.K.

TABLE 2

| | a | b | c | d | e | f | g | h | i |
|---|---|---|---|---|---|---|---|---|---|
| Hytrel 3078 | 40 | 40 | — | — | — | — | — | — | — |
| Hytrel 4047 | — | — | — | — | 100 | — | — | — | — |
| PEBAX 3533 | — | — | — | — | — | 100 | — | — | — |
| Primalloy A1500 | 60 | — | 100 | — | — | — | — | — | — |
| HPR AR 201 | — | 60 | — | 100 | — | — | — | — | — |
| Himilan 1706 | — | — | — | — | — | — | — | 60 | — |
| Surlyn 8120 | — | — | — | — | — | — | — | 40 | — |
| Barium sulfate | — | — | — | 25 | — | — | — | 5.6 | — |
| Polybutadiene | — | — | — | — | — | — | 100 | — | 100 |
| Zinc diacrylate | — | — | — | — | — | — | 34 | — | 11 |
| Dicumyl peroxide | — | — | — | — | — | — | 1 | — | 1 |
| Antioxidant | — | — | — | — | — | — | 0.1 | — | 0.1 |
| Barium sulfate | — | — | — | — | — | — | 6.4 | — | 8 |
| Zinc oxide | — | — | — | — | — | — | 5 | — | 5 |
| Zinc salt of pentachlorothiophenol | — | — | — | — | — | — | 1 | — | 1 |

Note:
Hytrel is the trade name of polyester elastomers by Toray-Dupont K.K.

TABLE 2-continued

| | a | b | c | d | e | f | g | h | i |
|---|---|---|---|---|---|---|---|---|---|

PEBAX is the trade name of polyamide elastomers by Atochem.
Primalloy is the trade name of polyester elastomer base polymer alloys by Mitsubishi Chemical Industry K.K.
HPR AR 201 is the trade name of maleic anhydride-graft-modified ethylene-ethyl acrylate copolymer resins by Mitsui-Dupont K.K.
Himilan is the trade name of ionomer resins by Mitsui-Dupont Polychemical K.K.
Surlyn is the trade name of ionomer resins by Dupont.

TABLE 3

| | A | B | C | D | E | F | G | H |
|---|---|---|---|---|---|---|---|---|
| Himilan 1601 | 50 | 37 | 26 | 40 | — | — | — | — |
| Himilan 1557 | 50 | 37 | 26 | 40 | — | — | — | — |
| Himilan 1605 | — | — | — | — | 50 | — | — | — |
| Himilan 1706 | — | — | — | — | 50 | — | 45 | 70 |
| Surlyn 8120 | — | 26 | 48 | 20 | — | 100 | 55 | 30 |
| Titanium dioxide | 5.6 | 5.6 | 5.6 | 5.6 | 5.6 | 5.6 | 5.6 | 5.6 |
| Barium sulfate | 28 | — | — | — | — | — | — | — |

Note:

Himilan is the trade name of ionomer resins by Mitsui-Dupont Polychemical K.K.

Surlyn is the trade name of ionomer resing by Dupont.

TABLE 4

| Set | Diameter (mm) | Depth (mm) | $v_0$ | Number | $v_R$ (%) |
|---|---|---|---|---|---|
| 1 | 4.10 | 0.200 | 0.46 | 32 | 0.950 |
| | 4.20 | 0.200 | 0.46 | 40 | |
| | 4.00 | 0.200 | 0.46 | 184 | |
| | 3.90 | 0.200 | 0.46 | 16 | |
| | 3.40 | 0.200 | 0.46 | 104 | |
| | 3.35 | 0.200 | 0.46 | 16 | |
| 2 | 3.85 | 0.195 | 0.50 | 288 | 0.977 |
| | 3.25 | 0.180 | 0.50 | 72 | |
| | 2.50 | 0.170 | 0.50 | 42 | |
| 3 | 3.85 | 0.185 | 0.46 | 340 | 1.124 |
| | 3.60 | 0.185 | 0.46 | 140 | |
| 4 | 3.90 | 0.150 | 0.47 | 240 | 0.663 |
| | 3.20 | 0.150 | 0.47 | 120 | |
| 5 | 3.85 | 0.160 | 0.50 | 288 | 0.803 |
| | 3.25 | 0.150 | 0.50 | 72 | |
| | 2.50 | 0.140 | 0.50 | 42 | |

TABLE 5

| | | Example | | | | |
|---|---|---|---|---|---|---|
| | | 1 | 2 | 3 | 4 | 5 |
| Core | Weight (g) | 25.9 | 27.9 | 33.6 | 20.4 | 25.0 |
| | Outer diameter (mm) | 35.2 | 35.2 | 37.9 | 30.6 | 35.2 |
| | Deflection (mm) | 5.0 | 5.2 | 4.0 | 2.8 | 4.4 |
| | Specific gravity | 1.132 | 1.222 | 1.180 | 1.360 | 1.094 |
| Intermediate layer | Type | a | b | c | c | d |
| | Shore D hardness B | 22 | 20 | 17 | 17 | 13 |
| | Weight* (g) | 33.3 | 35.2 | 37.8 | 35.2 | 33.3 |
| | Outer diameter* (mm) | 38.6 | 38.6 | 39.7 | 38.6 | 38.6 |
| | Specific gravity | 1.02 | 1.00 | 0.98 | 0.98 | 1.14 |
| | Gage (mm) | 1.70 | 1.70 | 0.90 | 4.00 | 1.70 |
| Cover | Type | A | B | C | D | A |
| | Specific gravity | 1.17 | 0.98 | 0.98 | 0.98 | 1.17 |
| | Gage (mm) | 2.05 | 2.05 | 1.50 | 2.05 | 2.05 |
| | Shore D hardness A | 62 | 55 | 52 | 56 | 62 |
| Hardness difference (A–B) | | 40 | 35 | 35 | 39 | 49 |
| Ball | Weight (g) | 45.3 | 45.3 | 45.3 | 45.3 | 45.3 |
| | Diameter (mm) | 42.7 | 42.7 | 42.7 | 42.7 | 42.7 |
| Dimple set | | 1 | 1 | 2 | 2 | 2 |
| Product (AxB) | | 1364 | 1100 | 884 | 952 | 806 |
| $V_R$ (%) | | 0.950 | 0.950 | 0.977 | 0.977 | 0.977 |
| Flight performance | | | | | | |
| W#1/HS45 | Carry (m) | 208.8 | 208.6 | 208.5 | 209.2 | 208.3 |
| | Total (m) | 223.5 | 222.8 | 222.5 | 222.6 | 223.0 |
| | Spin (rpm) | 2462 | 2501 | 2711 | 2803 | 2625 |

TABLE 5-continued

| | | Example | | | | |
|---|---|---|---|---|---|---|
| | | 1 | 2 | 3 | 4 | 5 |
| Trajectory | | liner-like, long-lasting, medium trajectory | liner-like, long-lasting, medium trajectory | rising, similar to balata ball | rising, similar to balata ball | somewhat rising, long-lasting, relatively low trajectory |
| I#9 | Spin (rpm) | 9128 | 9192 | 9326 | 9318 | 9187 |
| Feel | W#1 | VS | VS | VS | VS | VS |
| | I#9 | VS | VS | VS | VS | VS |
| | PT | VS | VS | VS | VS | VS |
| Durability | | OK | OK | OK | OK | OK |

*core + intermediate layer

TABLE 6

| | | Comparative Example | | | | | | |
|---|---|---|---|---|---|---|---|---|
| | | 1 | 2 | 3 | 4 | 5 | 6 | 7 |
| Core | Weight (g) | 27.1 | 30.2 | 16.7 | 29.6 | 30.7 | 35.4 | 25.0 |
| | Outer diameter (mm) | 35.2 | 36.4 | 29.7 | 36.5 | 36.5 | 38.7 | 34.0 |
| | Deflection (mm) | 3.0 | 3.0 | 2.3 | 2.9 | 2.9 | 4.5 | 2.3 |
| | Specific gravity | 1.185 | 1.196 | 1.214 | 1.164 | 1.205 | 1.168 | 1.214 |
| Intermediate layer | Type | e | f | g | e | h | — | i |
| | Shore D hardness B | 40 | 42 | 55 | 40 | 56 | — | 25 |
| | Weight* (g) | 35.2 | 38.5 | 35.4 | 37.8 | 37.8 | — | 35.2 |
| | Outer diameter* (mm) | 38.6 | 40.0 | 38.7 | 39.7 | 39.7 | — | 38.6 |
| | Specific gravity | 1.12 | 1.01 | 1.13 | 1.12 | 0.98 | — | 1.07 |
| | Gage (mm) | 1.70 | 1.80 | 4.50 | 1.60 | 1.60 | — | 2.30 |
| Cover | Type | E | F | E | G | H | E | G |
| | Specific gravity | 0.98 | 0.98 | 0.98 | 0.98 | 0.98 | 0.98 | 0.98 |
| | Gage (mm) | 2.05 | 1.35 | 2.00 | 1.50 | 1.50 | 2.00 | 2.05 |
| | Shore D hardness A | 63 | 45 | 63 | 53 | 58 | 63 | 53 |
| Hardness difference (A–B) | | 23 | 3 | 8 | 13 | 2 | — | 28 |
| Ball | Weight (g) | 45.3 | 45.3 | 45.3 | 45.3 | 45.3 | 45.3 | 45.3 |
| | Diameter (mm) | 42.7 | 42.7 | 42.7 | 42.7 | 42.7 | 42.7 | 42.7 |
| Dimple set | | ③ | ④ | ⑤ | ③ | ⑤ | ⑤ | ④ |
| Product (AxB) | | 2520 | 1890 | 3465 | 2120 | 3248 | — | 1325 |
| $V_R$ (%) | | 1.124 | 0.663 | 0.803 | 1.124 | 0.803 | 0.803 | 0.663 |
| Flight performance | | | | | | | | |
| W#1/HS45 | Carry (m) | 207.9 | 205.3 | 204.9 | 205.8 | 207.9 | 204.2 | 203.5 |
| | Total (m) | 221.0 | 217.5 | 217.3 | 218.1 | 219.2 | 218.5 | 215.3 |
| | Spin (rpm) | 2548 | 3001 | 2657 | 2898 | 2689 | 2480 | 3213 |
| Trajectory | | liner-like, low, dropping | skying, high | liner-like, long-lasting, medium trajectory | somewhat rising low, dropping | liner-like, long-lasting, medium trajectory | liner-like, long-lasting, medium trajectory | skying high |
| I#9 | Spin (rpm) | 8335 | 9343 | 8453 | 8935 | 8566 | 7786 | 9211 |
| Feel | W#1 | VS | Av | Hard | Hard | Hard | VS | Hard |
| | I#9 | Av | Av | Hard | VS | VS | Av | VS |
| | PT | Hard | Av | Hard | VS | Av | Av | VS |
| Durability | | OK | OK | OK | OK | OK | VW | OK |

*core + intermediate layer

As seen from the results of Tables 5 and 6, the three-piece balls of Examples 1 to 5 show a very soft pleasant feel when hit with any of the driver, No. 9 iron and putter, a high spin receptivity and ease of control when hit with No. 9 iron, and a good trajectory and a drastically increased flight distance upon full shots with the driver.

Japanese Patent Application No. 10-249262 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A multi-piece solid golf ball comprising a solid core, an intermediate layer of at least one layer around the core, and a cover of at least one layer around the intermediate layer, and having a plurality of dimples formed in the surface of the cover, and said dimples being composed of at least three different types in diameter and depth thereof wherein the dimples of the largest type have a diameter of 3.7 to 4.5 mm and a depth of 0.15 to 0.25 mm and account for 5 to 80% of the total dimples and the dimples of the smallest type have a diameter of 2.0 to 3.7 mm and a depth of 0.08 to 0.23 mm and account for 1 to 40% of the total dimples, wherein said cover is formed of a cover stock composed mainly of a thermoplastic resin and has a Shore D hardness A, and said intermediate layer has a Shore D hardness B, the Shore D hardness A of said cover is at least 20 units higher than the Shore D hardness B of said intermediate layer, the product (AxB) of the Shore D hardnesses of said cover and said intermediate layer and a dimple volume ratio $V_R$ (5), which is the ratio of the sum Vs of volumes of dimple spaces each defined below a plane circumscribed by the dimple edge to the volume of an imaginary sphere given on the assumption that no dimples are on the golf ball surface and is calculated according to the following equation:

$$V_R(\%) = \frac{Vs}{\frac{4}{3}\pi R^3} \times 100$$

wherein Vs is defined above and R is a ball radius, satisfy any one of the following relationships (1) to (6):

(1) $V_R$ is 0.79 to 1.15% when AxB is 150 to 500, (2) $V_R$ is 0.78 to 1.14% when AxB is 500 to 1,000

(3) $V_R$ is 0.77 to 1.13% when AxB is 1,000 to 1,500, (4) $V_R$ is 0.76 to 1.12% when AxB is 1,500 to 2,000, (5) $V_R$ is 0.75 to 1.11% when AxB is 2,000 to 2,500, and (6) $V_R$ is 0.74 to 1.10% when AxB is at least 2,500.

2. The multi-piece solid golf ball of claim 1 wherein said solid core is formed mainly of a rubber base and has a specific gravity of 1.0 to 1.5 and a deflection of at least 2.5 mm under an applied load of 100 kg.

3. The multi-piece solid golf ball of claim 1 wherein said intermediate layer is formed mainly of a thermoplastic resin.

4. The multi-piece solid golf ball of claim 1 wherein said intermediate layer has a Shore D hardness B of 5 to 35.

5. The multi-piece solid golf ball of claim 1 wherein said intermediate layer is formed mainly of a heated mixture of (E1) a thermoplastic polyester elastomer and (E2) at least one thermoplastic elastomer selected from olefin elastomers, modified olefin elastomers, styrene block copolymers and hydrogenated styrene block copolymers, or the thermoplastic elastomer defined as (E2).

6. The multi-piece solid golf ball of claim 1 wherein said intermediate layer has a thickness of 0.2 to 5.0 mm and a specific gravity of at least 0.8.

7. The multi-piece solid golf ball of claim 1 wherein said cover is formed mainly of an ionomer resin and has a thickness of 1.0 to 5.0 mm and a specific gravity of at least 0.9.

8. The multi-piece golf ball of claim 1, wherein the dimples have a volume $V_0$ of a dimple space of 0.38 to 0.55 which is below a plane circumscribed by the dimple edge divided by the volume of a cylinder whose bottom is the plane and whose height is the maximum depth of the dimple from the bottom.

9. The multi-piece golf ball of claim 1, wherein the golf ball has a total number of 360 to 460 dimples.

10. The multi-piece golf ball of claim 1, wherein said intermediate layer has a Shore D hardness B of 5 to 27.

11. The multi-piece golfball of claim 1, wherein the mixture of the intermediate layer has a (E1)/(E2) ratio of 95/5 to 0/100.

12. The multi-piece golf ball as defined in claim 2, wherein said core has a diameter of 25 to 40 mm.

13. The multi-piece golfball as defined in claim 12, wherein said core has a diameter of about 30 to 38 mm.

14. The multi-piece golf ball as defined in claim 4, wherein said intermediate layer has a Shore D hardness B of about 9 to 24.

15. The multi-piece golf ball as defined in claim 4, wherein said intermediate layer has a thickness of about 0.7 to 3.5 mm.

16. The multi-piece golf ball as defined in claim 1, wherein said cover has a Shore D hardness A of about 40 to 70.

17. The multi-piece golf ball as defined in claim 1, wherein said cover has a Shore D hardness A of about 40 to 70 and said intermediate layer has a Shore D hardness of about 5 to 35.

18. The multi-piece golfball as defined in claim 17, wherein the Shore D hardness A of said cover is about 30 to 50 units greater than the Shore D hardness B of said intermediate layer.

19. The multi-piece golfball as defined in claim 17, wherein said cover and/or intermediate layer comprises an inorganic filler.

20. The multi-piece golf ball as defined in claim 1, wherein there are six different types of dimples formed in said cover.

* * * * *